US005433595A

United States Patent [19]

Wentzell et al.

[11] Patent Number: 5,433,595

[45] Date of Patent: Jul. 18, 1995

[54] SURVIVAL CANDLE

[76] Inventors: Ken N. Wentzell, 46 Douglas Drive, Beaverbank, NS, Canada, B4G 1C5; Barrie M. Burt, 1932 Brainerd Ct., Lutz, Fla. 33549

[21] Appl. No.: 240,174

[22] Filed: May 9, 1994

[51] Int. Cl.[6] ..... F23D 3/16

[52] U.S. Cl. ..... 431/289; 431/125; 431/253

[58] Field of Search ..... 431/289, 253, 124, 125; 126/263, 262

[56] References Cited

U.S. PATENT DOCUMENTS

| | | | |
|---|---|---|---|
| 2,077,703 | 4/1937 | Little | 126/262 |
| 2,250,710 | 7/1941 | Hutt | 431/253 X |
| 2,775,882 | 1/1957 | Doig | 431/289 X |
| 2,801,627 | 8/1957 | Burke et al. | 126/262 |
| 2,817,226 | 12/1957 | Dickman | 431/253 X |
| 3,327,505 | 6/1967 | Brown | 431/288 |
| 4,826,428 | 5/1989 | Lam | 431/289 X |
| 5,154,600 | 10/1992 | Sylvestre | 431/289 X |

FOREIGN PATENT DOCUMENTS

| | | | |
|---|---|---|---|
| 74958 | 8/1930 | Sweden | 431/289 |

*Primary Examiner*—Larry Jones

[57] ABSTRACT

An survival candle including a solid cylindrical wax candle having a wick disposed along a portion of an axis therein, and furthermore a small container having a detachable closure is embedded within the candle thereby providing a weatherproof compartment for storage of items of potential use in a wilderness survival environment including but not limited to matches, foodstuffs, a compass, foil, and medical supplies. In operation the survival candle is gripped at each end and rotatably twisted to provide access to the small container.

3 Claims, 4 Drawing Sheets

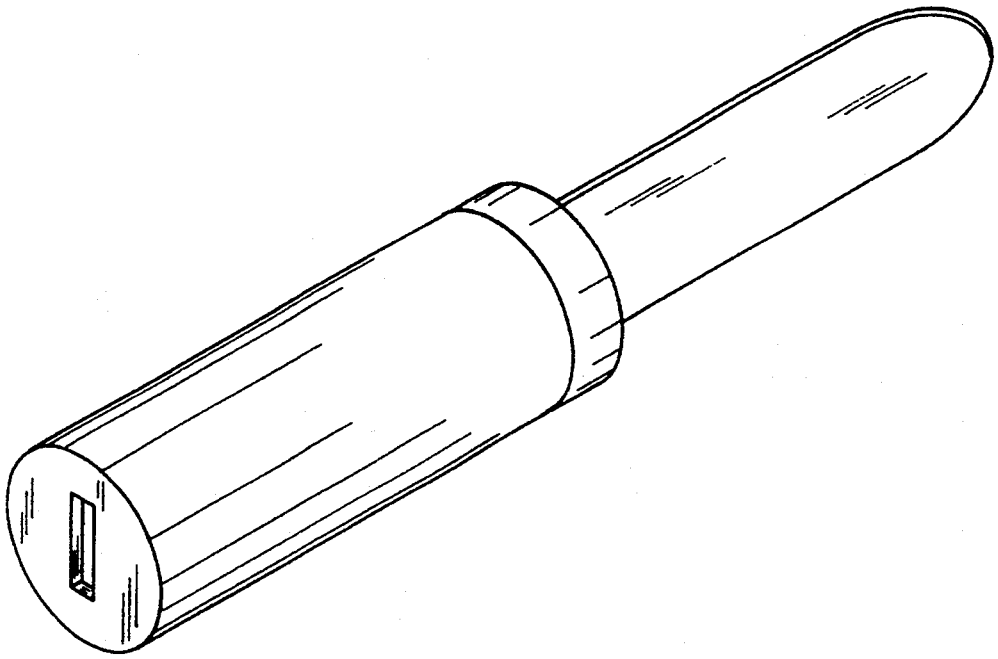
PRIOR ART FIG. 1
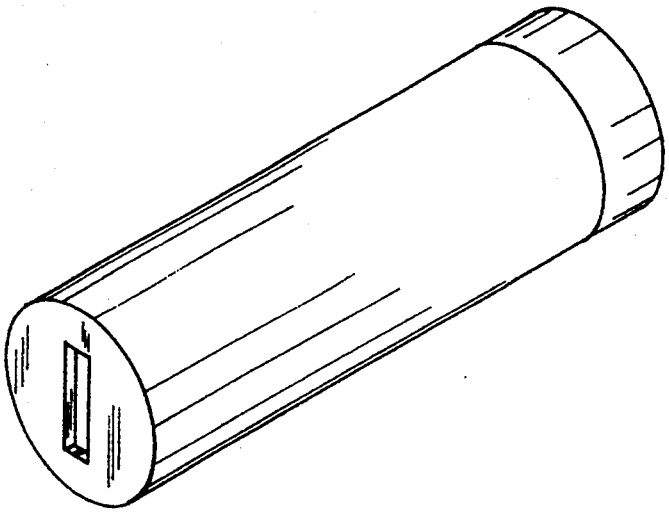
PRIOR ART FIG. 2

SURVIVAL CANDLE

BACKGROUND OF THE INVENTION

1. Field of the Invention

The present invention relates to survival equipments and more particularly pertains to a survival candle which may be employed to securely contain several items of use in human wilderness survival.

2. Description of the Prior Art

The use of survival equipment is known in the prior art. More specifically, survival equipment heretofore devised and utilized for securely containing items of use in human wilderness survival are known to consist basically of familiar, expected and obvious structural configurations, notwithstanding the myriad of designs encompassed by the crowded prior art which have been developed for the fulfillment of countless objectives and requirements.

The present invention is directed to improving devices for a survival candle in a manner which is safe, secure, economical and aesthetically pleasing.

For example, U.S. Pat. No. 4,917,597 to Henze discloses a wax candle comprising a dual component wax candle wherein a first inner wax component melts between 52C and 56C and a second outer wax component melts between 74C and 78C. There is no provision in the Henze invention for securing items of survival within the candle body. The present invention comprises a candle having a jarlike container embedded therewithin which contains items of use to humans for wilderness survival.

In U.S. Pat. No. 4,944,392 to Hull et al. a combination match safe, knife, and striker is disclosed. The Hull et al. invention comprises a tubular handheld device having a knife blade, a secure storage region for matches, a match striker, and a flint for fire lighting. The Hull et al. invention incorporates some equipments of use for survival however there is no candle and associated wax therein, nor is there a secure container containing other materials of survival in addition to matches. The present invention comprises a wax candle having a container embedded therein containing several items of use in survival situations.

In U.S. Pat. No. 4,075,078 to Nickell a survival kit container is described wherein a multipurpose container is used to hold many items of survival use. The multipurpose container may be alternately employed as a cooking pot and platter, and is generally equipped with a first aid kit, compass, knife, and several other items. The Nickell invention is not sealed against the elements and comprises a large item not generally pocket portable. The present invention comprises a sealed container capable of being carried ion a pocket and contains several survival items sealed from the elements.

In U.S. Pat. No. 3,951,260 to Frazee a survival kit is disclosed for a backpack style survival kit having a large selection of human survival equipments including a pressurized gas cylinder and an associated brightly colored tethered balloon. A disadvantage in this prior art lies in a lack of pocket portability. The present invention is capable of pocket transport and can house several items of survival gear therein in a secure condition free from adverse action of the elements.

In this respect, the survival candle according to the present invention substantially departs from the conventional concepts and designs of the prior art, and in so doing provides an apparatus primarily developed for the purpose of securely holding several items of use to human survival in wilderness areas.

Therefore, it can be appreciated that there exists a continuing need for new and improved survival candle which can be used by a human to carry several items of survival interest on a person without deterioration induced by the elements. In this regard, the present invention substantially fulfills this need.

As illustrated by the background art, efforts are continuously being made in an attempt to improve survival equipment. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of survival equipments now present in the prior art, the present invention provides an improved survival candle construction wherein the same can be utilized for secure containment of several items of use for human survival. As such, the general purpose of the present invention, which will be described subsequently in greater detail, is to provide a new and improved survival candle apparatus and method which has all the advantages of the prior art survival kits and devices and none of the disadvantages.

The invention is defined by the appended claims with the specific embodiment shown in the attached drawings. For the purpose of summarizing the invention, the invention may be incorporated into a wax candle having a sealable container and cover embeddedly sealed therein and furthermore the sealable container contains several items of use in survival scenarios including matches, dried foodstuffs, fishing hook and line, foil, and other devices.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved survival candle having a sealed compartment embedded therein.

It is therefore an additional object of the present invention to provide a new and improved survival candle which has all the advantages of the prior art survival candles and equipments and none of the disadvantages.

It is another object of the present invention to provide a new and improved survival candle which may be easily and efficiently manufactured and marketed.

It is a further object of the present invention to provide a new and improved survival candle which is of a durable and reliable construction.

An even further object of the present invention is to provide a new and improved survival candle which is susceptible of a low cost of manufacture with regard to both materials and labor, and which accordingly is then susceptible of low prices of sale to the consuming public, thereby making such survival candles economically available to the buying public.

Still yet another object of the present invention is to provide a new and improved survival candle which provides in the apparatuses and methods of the prior art some of the advantages thereof, while simultaneously overcoming some of the disadvantages normally associated therewith.

Still another object of the present invention is to provide a new and improved survival candle capable of holding matches, fishing line and a hooks, foil, foodstuffs, a small knife, antibiotic/antiseptic, wound dressing, foil and other items in security from the elements.

Yet another object of the present invention is to provide a new and improved survival candle which is small in size and may be carried in a pocket.

Even still another object of the present invention is to provide a new and improved survival candle which may be used for emergency lighting in cases of power outages at home or in the office These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is prior art.

FIG. 2 is prior art.

DESCRIPTION OF THE PREFERRED EMBODIMENT

Figure 3:
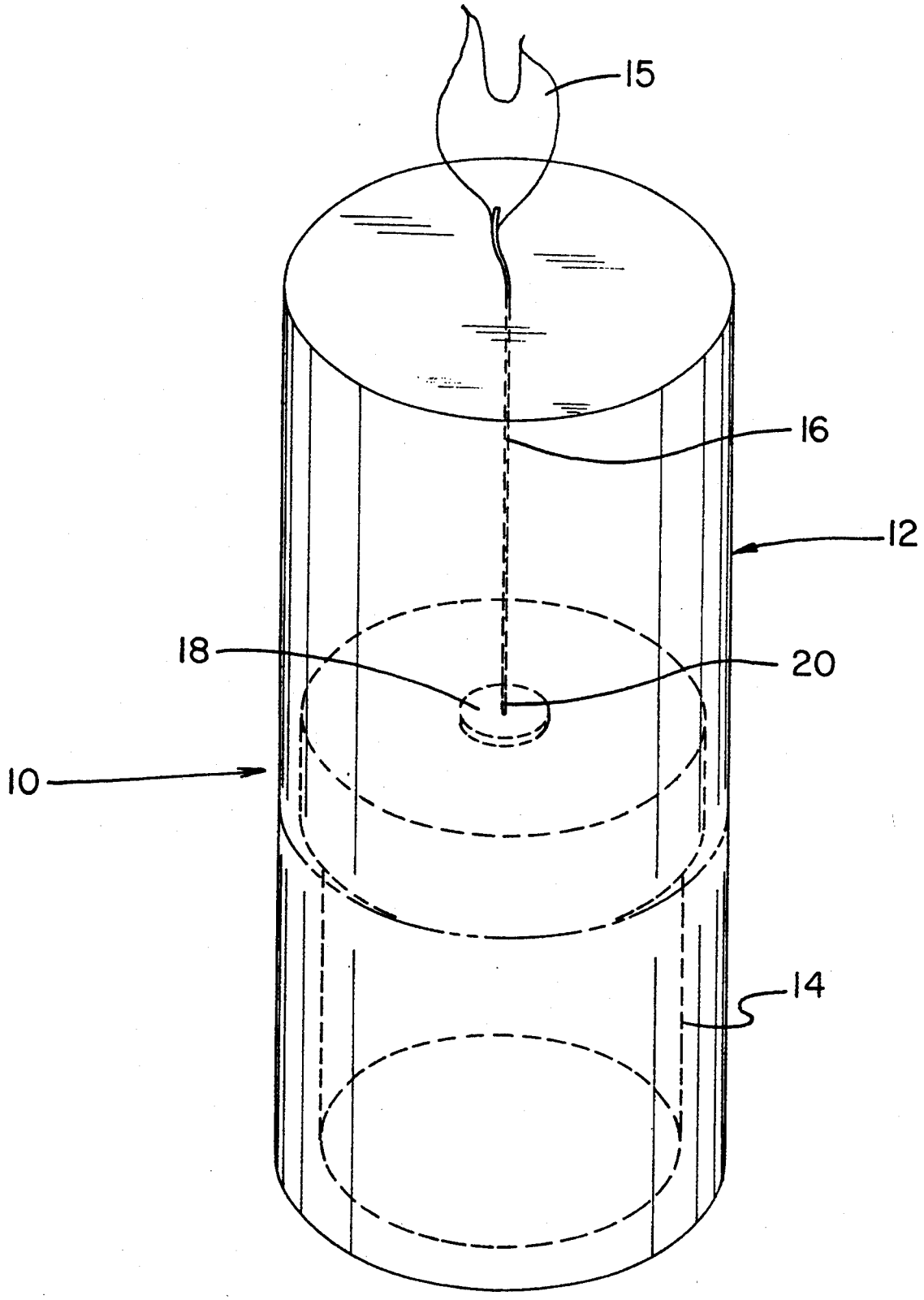
FIG. 3 is a perspective view of the survival candle showing the candle and jar disposition.

With reference now to the drawings, and in particular to FIG. 1 thereof, a new and improved survival candle embodying the principles and concepts of the present invention and generally designated by the reference numeral 10 will be described.

From an overview standpoint, the survival candle 10 is adapted for use under conditions requiring emergency light, fire, food, or navigation wherein candle member 12 may be fractured to reveal an embedded container 14 which sealably safeguard several items of human survival usage. See FIG. 3. Candle member 12 may be ignited using matches held in security within container 14 thereby producing flame 15. Flame 15 may be employed to provide illumination or to aid in igniting and sustaining a fire using existing indigenous fuels.

Figure 4:
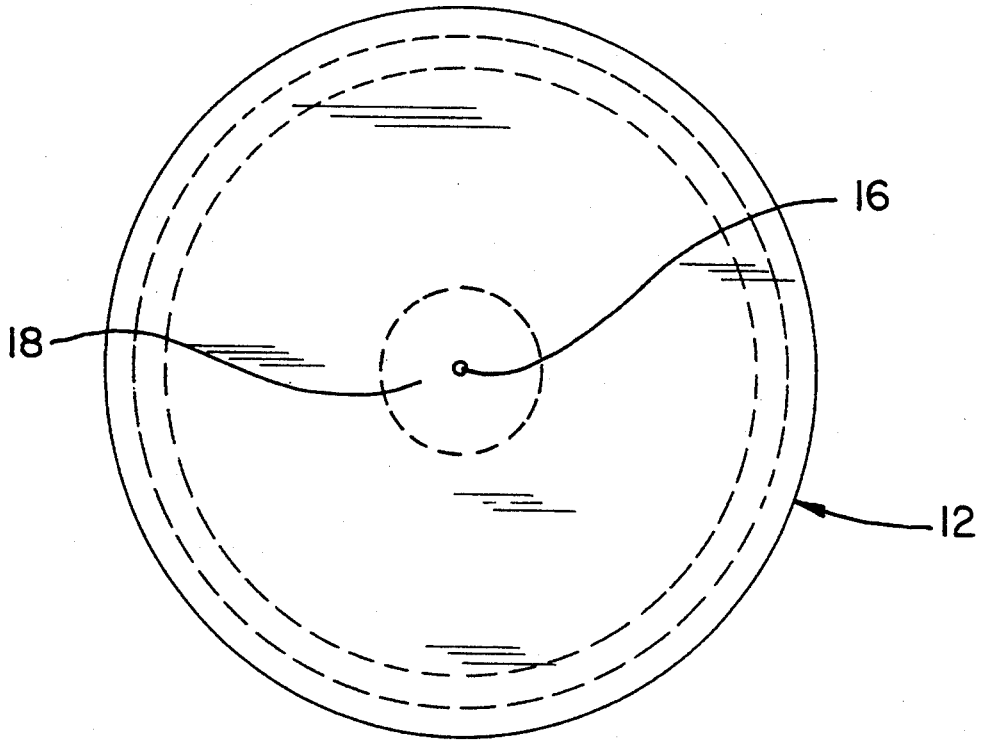
FIG. 4 is a side elevational view of the survival candle.

More specifically, it will be noted that the survival candle 10 comprises a solid cylindrical wax candle member 12 having a container 14 embedded therein. Wax candle member 12 has a centrally disposed wick member 16, and may have a ballast member 18 affixed to a wick end 20 wherein said wick end 20 is deeply embedded within candle member 12. See FIG. 4. Ballast member 18 is employed during candle manufacture to maintain the wick member 16 substantially along a central axis of candle member 12 during manufacture by a casting process. In one technique of manufacture of the survival candle 10 a cylindrical casting tube may be employed wherein container 14 is first placed in the casting tube then the wick member is suspended therein with the ballast member 18 held in contact with or in close proximity to container 14. Molten wax is subsequently introduced within the casting tube and the survival candle 10 is formed upon solidification of the wax therein. Colored bands may be introduced within the survival candle 10 by casting a first colored wax layer to a particular partial fill depth and permitting the first colored wax layer to solidify before casting a second colored wax layer to a particular partial fill depth, and repeating the aforedescribed layer casting process until a desired number of colored layers are formed in the finished product. A particular disposition of colors may correspond to a solid candle portion of a color such as white, a centrally disposed portion of intermediate or unsaturated color such as pink is cast in a narrow band and is indicative of the location of a top portion of container 14 embedded within the candle wax mass, and a container 14 locating color being dark or saturated in nature such as red. Several waxes and wax blends may be employed in the. survival candle 10 and waxes having different melting temperature ranges may be layered in two or more annular cylinders to provide immunity to thermal degradation in hot environments and additionally to permit low melting point wax pooling near the wick member 16 thereby producing an extended burn duration by maintaining liquid fuel near the flame front. Wick member 16 and the surrounding candle wax may be treated with chemicals which enhance ignitability under adverse environmental conditions. Chemicals such as inorganic chlorates and nitrates may be employed to improve ignitability. Wax additives may include microencapsulated highly energetic components which will permit continued burning in severe rain and wind.

Figure 5:
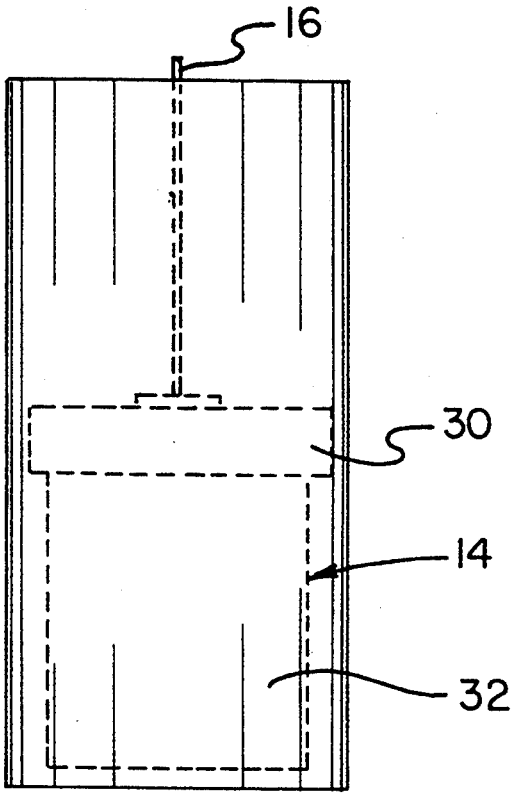
FIG. 5 is a side elevational view of a survival candle in the storage position.
Figure 6:
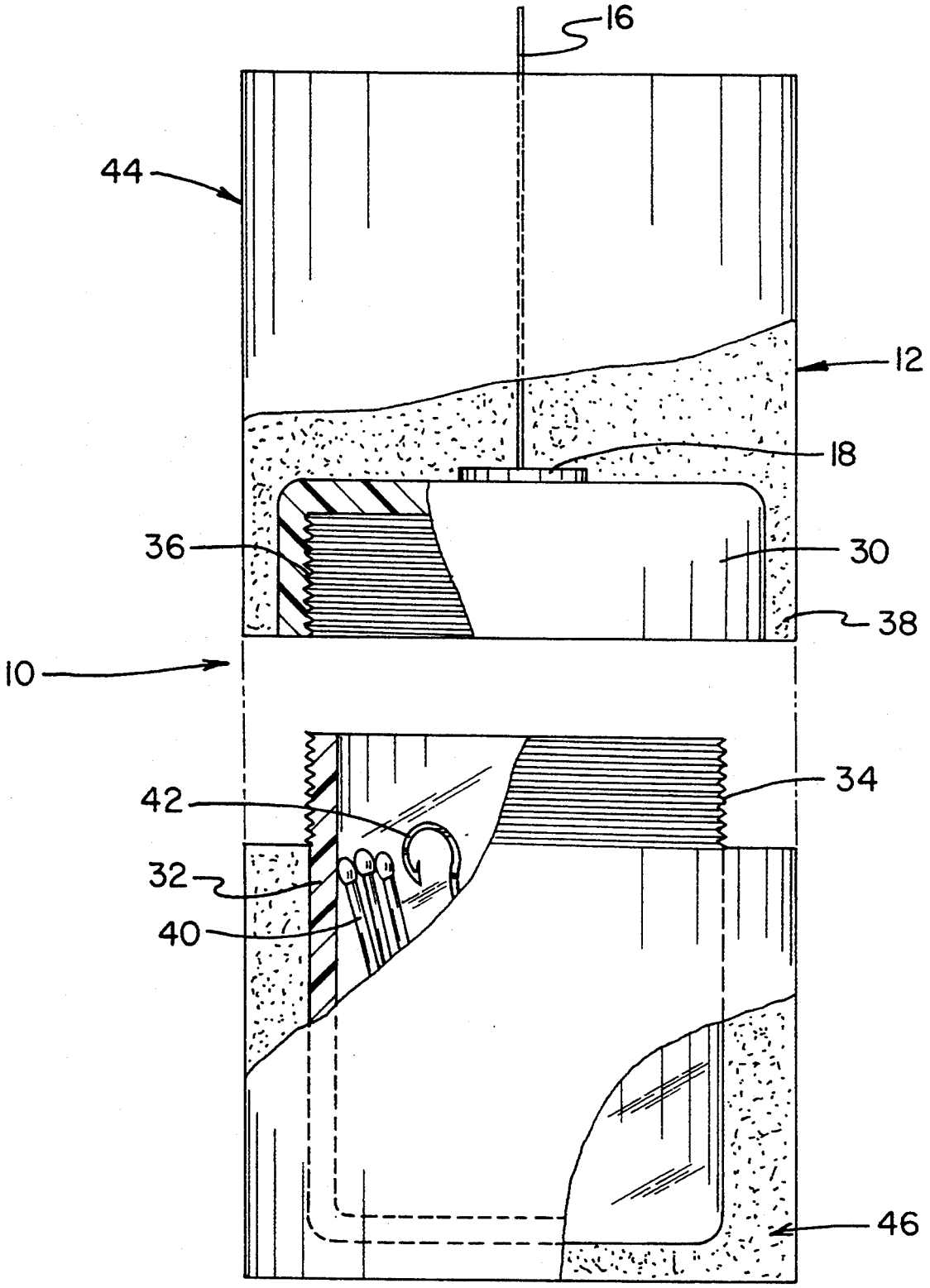
FIG. 6 is a partial cutaway view of the survival candle in the open state showing a jar member and several survival items disposed therein.

Embedded container 14 comprises a cover member 30 and a cuplike member 32. See FIGS. 5 and 6. Cover member 30 and cup member 32 threadedly engage using cooperating threads 34 and 36 thereby substantially sealing the contents of container 14 from the effects of environmental adversities such as water vapor, liquid water, and solvents. Candle wax surround 38 further seals container 14 thereby rendering a substantially improved impermeability to the region of engagement of threads 34 and 36. Container 14 may hold any of a variety of survival items including but not limited to matches 40, fish hook 42, fishing line, a string saw, a small knife, bouillon cube type dehydrated soup stock, sugar, salt, antibiotics, antiseptics, aspirin, bandages, aluminum foil, a magnetic compass, a small mirror, a magnifying glass, and an antihistamine.

The survival candle 10 may be used for lesser emergencies such as a home power failure wherein the entire survival candle 10 is placed upright in a safe location, preferably in a shallow dish or plate, and lighted without accessing any portion of embedded container 14. In a typical survival situation the survival candle 10 may be grasped at each end wherein oppositely directed repetitive twisting motions are provided to each end thereof. The result of the aforementioned twisting motion is to threadedly disengage threads 34 and 36 thereby separating the survival candle 10 into a first part 44 and a second part 46. First part 44 comprises a substantial portion of candle member 12 including wick member 16, ballast member 18, and cover member 30. Second part 46 comprises a small wax portion of candle member 12, cuplike member 32, and the contents of cuplike member 32 including matches 40 and fish hook 42. First part 44 may be ignited using matches 40 and be employed for illumination or firestarting. Second part 46 may be emptied of contents therein and be further used for drinking or food preparation. Wax may be removed from second part 46 and be used as firestarting fuel, and furthermore cuplike member 32 may be of a composition permitting the boiling of liquids contained therein over a fire or flame 15. Cuplike member 32 and cover member 30 may comprise metallic or polymeric substances.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved survival candle for use by humans as emergency provisions comprising:

an ignitable illumination candle having a substantially solid waxlike fuel surrounding a wick embedded within wherein a free first ignition end of the wick protrudes from the waxlike fuel surface, said solid waxlike fuel having colorant added to one form or portions thereof; and a container having a detachable closure wherein said container is substantially embedded within a portion of the wax candle and furthermore said portion of the wax candle is disposed at an end opposite the first ignition end of the wick.

2. The new and improved survival candle of claim 1 in which said colored solid waxlike fuel is provided in three distinctly separated layers wherein a first colored layer comprises a candle portion having the wick member disposed therein, a second colored layer centrally disposed at the general location of said detachable closure, a third colored layer disposed to cover the container.

3. A new and improved survival candle for use by humans as emergency provisions comprising:

an ignitable illumination candle having a substantially solid waxlike fuel surrounding a wick embedded within wherein a free first ignition end of the wick protrudes from the waxlike fuel surface; and a container having a detachable closure wherein said container is substantially embedded within a portion of the wax candle and furthermore said portion of the wax candle is disposed at an end opposite the first ignition end of the wick, said container comprising a small bottle having a threadedly engaging lid member engaging a cuplike second member, said container being of a metallic composition and said lid being of a rigid composition selected from the class of rigid compositions including metals and polymers.

* * * * *